United States Patent [19]

Opresko et al.

[11] Patent Number: 4,870,320

[45] Date of Patent: Sep. 26, 1989

[54] COLOR PICTURE TUBE HAVING AN ELECTRON GUN WITH REDUCED CONVERGENCE DRIFT

[75] Inventors: Stephen T. Opresko, Manor Township, Lancaster County; Bruce G. Marks; Loren L. Maninger, both of East Hempfield Township, Lancester County, all of Pa.

[73] Assignee: RCA Licensing Corporation, Princeton, N.J.

[21] Appl. No.: 220,752

[22] Filed: Jul. 18, 1988

[51] Int. Cl.[4] ..... H01J 29/02; H01J 29/82

[52] U.S. Cl. ..... 313/412; 313/39; 313/456

[58] Field of Search ..... 313/412, 414, 448, 449, 313/456, 39, 457

[56] References Cited

U.S. PATENT DOCUMENTS 4,491,764 1/1985 D'Amato ..... 315/3

4,514,661 4/1985 Stone ..... 315/3

4,629,933 12/1986 Bijma et al. ..... 313/414

4,697,120 9/1987 Alig et al. ..... 313/412

*Primary Examiner*—Kenneth Wieder

*Attorney, Agent, or Firm*—Joseph S. Tripoli; Dennis H. Irlbeck

[57] ABSTRACT

The present invention provides an improved electron gun in a color picture tube. Such electron gun includes a beam-forming region comprising cathodes and at least two electrodes and a main focus lens formed by two electrodes. The cathodes and all of the electrodes are interconnected to a plurality of insulative support rods. The improvement comprises forming a first focus lens electrode, nearest the beam-forming region, of two separated portions that are electrically connected. The portion of the first focus lens electrode that is nearest the other focus lens electrode only is interconnected to the support rods near the main focus lens. The portion of the first focus lens electrode that is nearest the beam-forming region is connected to the support rods immediately adjacent to a beam-forming electrode.

2 Claims, 4 Drawing Sheets

COLOR PICTURE TUBE HAVING AN ELECTRON GUN WITH REDUCED CONVERGENCE DRIFT

This invention relates to color picture tubes having electron guns therein that produce three electron beams and, particularly, to an electron gun having reduced convergence drift within a tube.

In a color picture tube, convergence is the bringing together of three electron beams at a phosphor screen of the tube. In a delta electron gun, all three electron beams must be slightly deflected toward each other to effect convergence. In an inline electron gun, two off-axis side beams must be slightly deflected toward a center beam to effect convergence.

Most current commercial color picture tube systems utilize a combination including an inline electron gun and a self-converging yoke. The inline electron gun includes means therein for causing a static convergence of the beams at the center of the screen, and the yoke includes means for maintaining the convergence as the beams are deflected to form a raster on the screen.

The means in an inline electron gun for causing static convergence of the side beams with the center beam usually is an asymmetry formed in the main focus lens in the path of each side beam. This asymmetry is effected by forming the shape of one main focus electrode differently than the shape of a second main focus electrode. In one type of inline electron gun, side apertures in a second electrode are slightly offset from the corresponding apertures in the first electrode. In another type of electron gun, the side apertures in the electrodes are slightly skewed to the paths of the side beams. In yet another type of electron gun having focus electrodes with rims extending around the three electron beam paths, the rim of one electrode is shaped differently than the rim of the other electrode to effect static convergence.

One of the problems, encountered in color picture tubes having the static convergence feature built into an electron gun, is a drift in convergence during tube operation. If the electron beams of a tube are converged when the tube is energized, they become misconverged as the tube warms up. Or, alternatively, if an electron gun is designed to properly converge the electron beams at a steady-state condition, the beams will be misconverged during tube warm-up.

The present invention provides a modification in electron gun design that reduces convergence drift of the electron beams.

SUMMARY OF THE INVENTION

The present invention provides an improved electron gun in a color picture tube. Such electron gun includes a beam-forming region comprising cathodes and at least two electrodes and a main focus lens formed by two electrodes. The cathodes and all of the electrodes are interconnected to a plurality of insulative support rods. The improvement comprises forming a first focus lens electrode, nearest the beam-forming region, of two separated portions that are electrically connected. The portion of the first focus lens electrode that is nearest the other focus lens electrode is interconnected to the support rods only near the main focus lens. The portion of the first focus lens electrode that is nearest the beam-forming region is connected to the support rods immediately adjacent to a beam-forming electrode.

DETAILED DESCRIPTION OF THE PREFERRED EMBODIMENT

Figure 1:
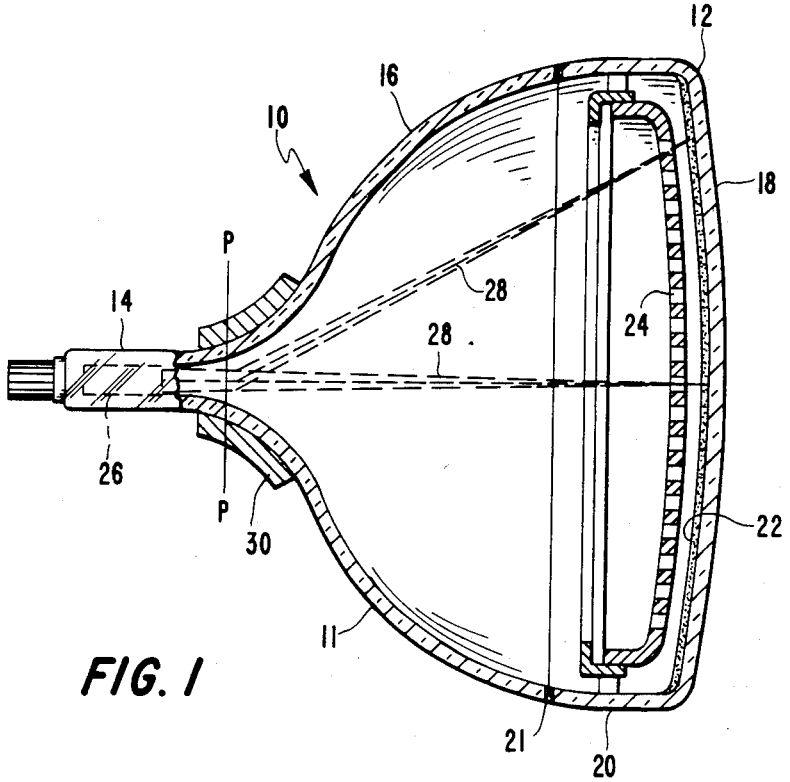
FIG. 1 is a plan view, partly in axial section, of a shadow mask color picture tube embodying the invention.

FIG. 1 shows a rectangular color picture tube 10 having a glass envelope 11 comprising a rectangular faceplate panel 12 and a tubular neck 14 connected by a rectangular funnel 16. The panel 12 comprises a viewing faceplate 18 and a peripheral flange or sidewall 20 which is sealed to the funnel 16 with a frit seal 21. A mosaic three-color phosphor screen 22 is located on the inner surface of the faceplate 18. The screen preferably is a line screen with the phosphor lines extending substantially perpendicular to the high frequency raster line scan of the tube (normal to the plane of FIG. 1). Alternatively, the screen could be a dot screen. A multiapertured color selection electrode or shadow mask 24 is removably mounted, by conventional means, in predetermined spaced relation to the screen 22. An improved inline electron gun 26, shown schematically by dashed lines in FIG. 1, is centrally mounted within the neck 14 to generate and direct three electron beams 28 along coplanar convergent paths through the mask 24 to the screen 22.

The tube of FIG. 1 is designed to be used with an external magnetic deflection yoke, such as the yoke 30 in the neighborhood of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is shown by the line P—P in FIG. 1 at about the middle of the yoke 30. For simplicity, the actual curvature of the deflection beam paths in the deflection zone is not shown in FIG. 1.

Figure 2:
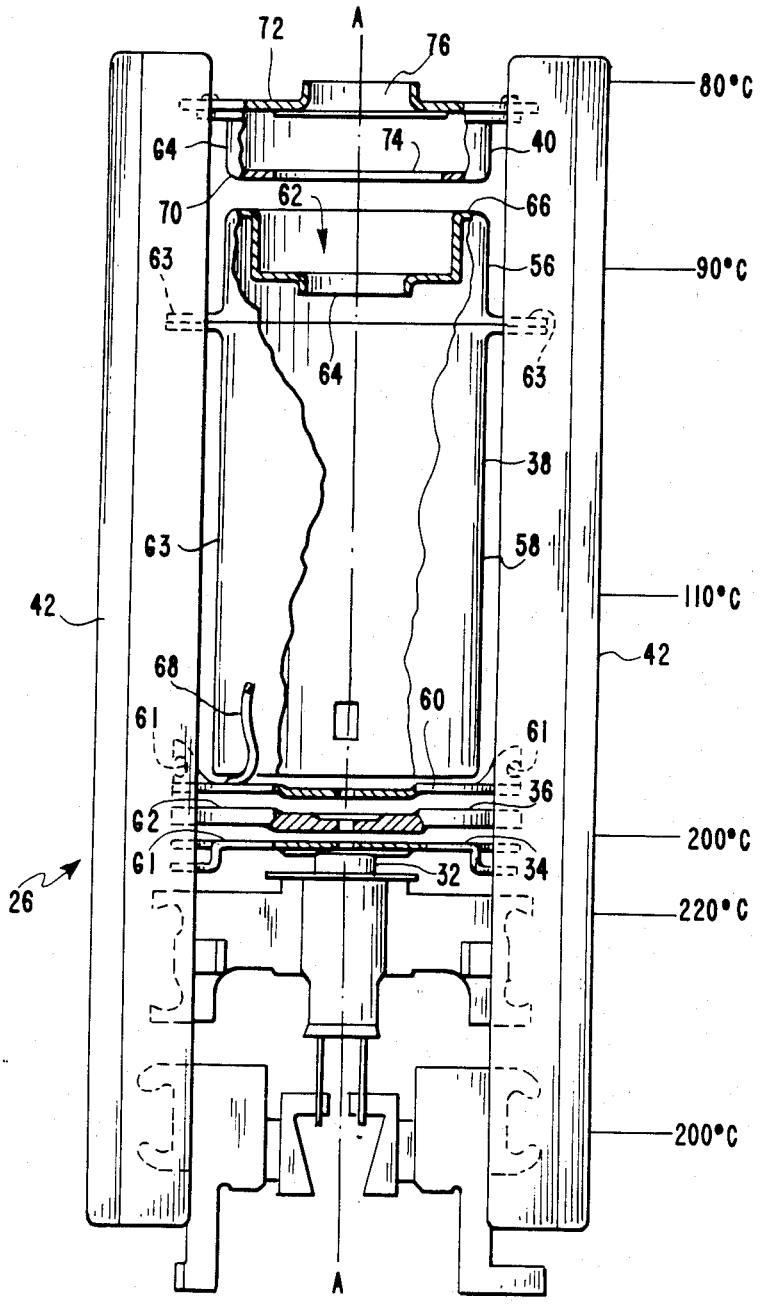
FIG. 2 is a side view, partially in section, of the electron gun shown in dashed lines in FIG. 1.

The details of the gun 26 are shown in FIG. 2. The gun 26 comprises three equally spaced coplanar cathodes 32 (one for each beam), a control grid electrode 34 (G1), a screen grid electrode 36 (G2), a first focus electrode 38 (G3), and a second focus electrode 40 (G4), spaced in the order named and attached to two insulative glass support rods 42.

The cathodes 32, the G1 electrode 34, the G2 electrode 36 and the side of the G3 electrode 38, facing the G2 electrode 36, comprise the beam-forming region of the electron gun 26. The other side of the G3 electrode 38 and the G4 electrode 40 comprise the main focusing lens portion of the gun 26. The main focusing lens is a bipotential type.

Each cathode 32 comprises a cathode sleeve closed at the forward end by a cap that is coated with an electron emissive material. Each cathode 32 is indirectly heated by a heater coil positioned within the sleeve. The control and screen grid electrodes, 34 and 36, are two closely-spaced plates, each having three small apertures therein, centered with the cathode coatings to initiate three equally-spaced coplanar electron beams 28 extending toward the screen 22. Preferably, the initial electron beam paths are substantially parallel, with the middle path coincident with the central axis A—A.

The G3 electrode 38 is formed by three elements 56, 58 and 60. One element 56, that forms the main focus lens, is cup-shaped and has a large recess 62 therein. The recess 62 sets back a portion of the closed end of the element 56 that contains three inline apertures 64. The remaining portion of the closed end of the element 56 forms a rim 66 that extends peripherally around the recess 62. The open end of the element 56 is connected to a cylindrical element 58 that has an oval cross-section. Two claws 63 extend from the junction of elements 56 and 58 and are embedded in the two support rods 42. The claws 63 provide the sole support for the elements 56 and 58. The third element 60 of the G3 electrode 38 is an apertured plate that is spaced from an open end of the cylindrical element 58. The plate element 60 is electrically connected to the cylindrical element 58 by a conductive metal ribbon 68. Two claws 61 extend from the plate element 60 and are embedded in the two support rods 42.

The G4 electrode 40 is formed by two elements 70 and 72. One element 70 is cup-shaped and has a single large elongated aperture 74 in its closed end. The second element 72 is a plate having three inline apertures 76 therein. The second element 72 is attached to and closes the open end of the cup-shaped element 70.

Figure 3:
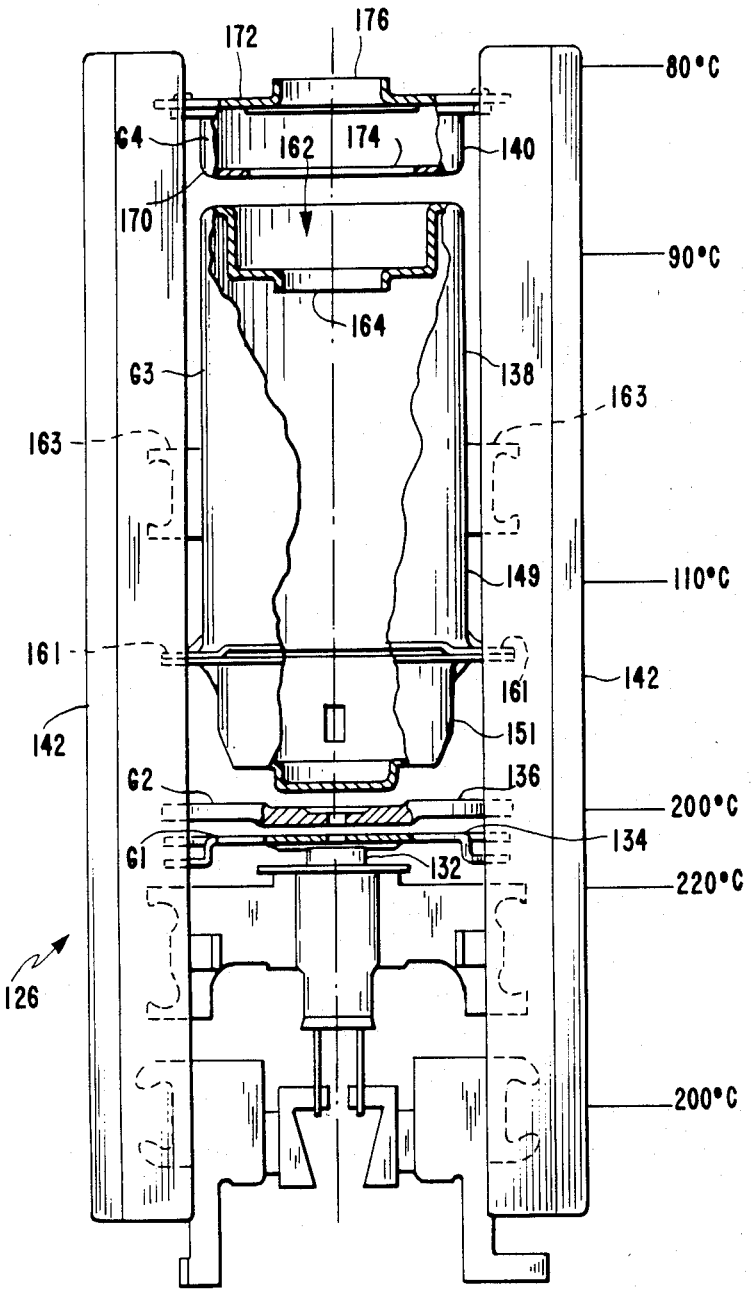
FIG. 3 PRIOR ART
FIG. 3 is a side view, partially in section, of a prior art electron gun.

The foregoing describes the novel electron gun 26 containing an embodiment of the present invention. For comparison, a prior art electron gun 126 is shown in FIG. 3. Parts of the prior art electron gun 126 that are similar to those in the novel electron gun 26 are labelled with the same number prefaced by a 1. For example, the cathodes of the novel gun 26 are labelled 32, whereas the cathodes of the prior art gun are labelled 132.

The only difference in construction of the prior art electron gun 126 from that of the novel gun 26 is in the G3 electrode 138. In the electron gun 126, the G3 electrode 138 includes two elements 149 and 151 that are directly attached to each other. Both elements 149 and 151 are cup-shaped and are attached to each other at their open ends. The closed end of the element 149 has a large recess 162 therein that sets back a portion containing three inline apertures 164. The other element 151 has three inline apertures in its bottom portion that faces the G2 electrode 136. The G3 electrode 138 is attached to the support rods 142 at two longitudinal locations. First, two claws 161 extend from the junction of the elements 149 and 151 and are embedded in the rods 142. Second, two claws 163 are attached to the sides of the element 149 and also are embedded in the rods 142.

During operation of an electron gun, it is important to maintain the positions and dimensions of the facing portions of the electrodes that form the main focus lens and to maintain the relative positions and alignments of the apertures in the beam-forming region of the gun. In the electron gun 26, the element 56 and the apertures 64 and rim 66 of the G3 electrode 38 must be stable relative to the G4 electrode 40. Also, the positions of the apertures in the plate element 60 must remain stable relative to the apertures in the G2 electrode 36. It has been discovered that a major cause of instability between electrodes is the greater thermal expansion of one of the electrodes relative to an adjacent electrode. The primary mode of heat transfer from the cathode heaters occurs by conduction through the glass support rods. Temperatures at various points on the support rods 42 of the electron gun 26 are shown in FIG. 2. The temperature of the rods 42 at the cathode is about 220° C. At the main focus lens, the temperature of the rods 42 is in the 80°–90° C. range. As shown in FIG. 3, the prior art gun 126 also has the same temperature distribution along its support rods 142.

In the prior art electron gun 126 of FIG. 3, the G3 electrode 138 is connected to the support rods 142 at two longitudinally spaced locations. One location is at the junction of the two elements 149 and 151, and the other location is at about the midpoint of the electrode. In this prior art gun 126, heat flows along the support rods from the cathode area and into the G3 electrode 138 at the junction of the two elements 149 and 151. The temperature at this point is about 115° C. Some heat may also flow by conduction into the G3 electrode through the midpoint support connection. The rod temperature at this point is about 100° C. Because of this conductive heat flow, the temperature of the end of the G3 electrode 138 that forms the main focus lens becomes appreciably higher than that of the facing G4 electrode 140 which is connected to the odds 142 near the 80° C. point. This greater temperature of the G3 electrode 138 causes it to expand more than the G4 electrode 140. Furthermore, within the G3 electrode 138 itself, there is a drain of heat from the beam-forming end of the electrode to the main focus lens end of the electrode. This drain, which is especially large during tube warmup, results in significant difference in temperature between the G2 electrode 136 and the facing end of the G3 electrode 138. Over the warmup period, this temperature difference constantly changes, thereby contributing to convergence drift. Furthermore, in the electron gun 126, there is a fulcrum arm formed between the two claws 161 and the end of the element 151 facing the G2 electrode 136. This fulcrum arm may contribute to misalignment of the apertures caused by mechanical twisting of the element 151 during tube warmup or during mechanical assembly of the electron gun. In the novel electron gun 26, this fulcrum arm is eliminated.

In the novel electron gun 26 of FIG. 2, there are claws 61 extending from the plate element 60 which are embedded in the support rods 42 immediately adjacent to the G2 electrode 36. The remaining portion of the G3 electrode 38, comprising the elements 56 and 58, are attached to the support rods 42 by another set of claws 63 located near the G4 electrode 40. Therefore, the operating temperature of the element 60 is close to that of the temperature of the G2 electrode 36 and their thermal expansions are similar since their connections to the rods 42 are located close to each other. Also, since the elements 56 and 58 are only attached to the support rods 42 near to the G4 electrode 40, the temperature of this portion of the G3 electrode will be closer to the temperature of the G4 electrode 40 than in the prior art electron gun 126.

Because of the lower operating temperature differences between the electrodes of the novel electron gun 26, performance of the electron gun, especially during tube warm-up, is substantially improved. Furthermore, in the electron gun 26, the thermal mass of the element 60 is close to that of the G2 electrode 36. Therefore, the mechanical behaviors of the element 60 and G2 electrode 36 are similar during thermal expansion. Computer results and subsequent tube test results indicate that within the first 10 minutes of tube operation, a modification from the design of the prior art electron gun 126 to the design of the novel electron gun 26 can reduce the convergence drift of the outer beams by as much as 50 percent.

Figure 4:
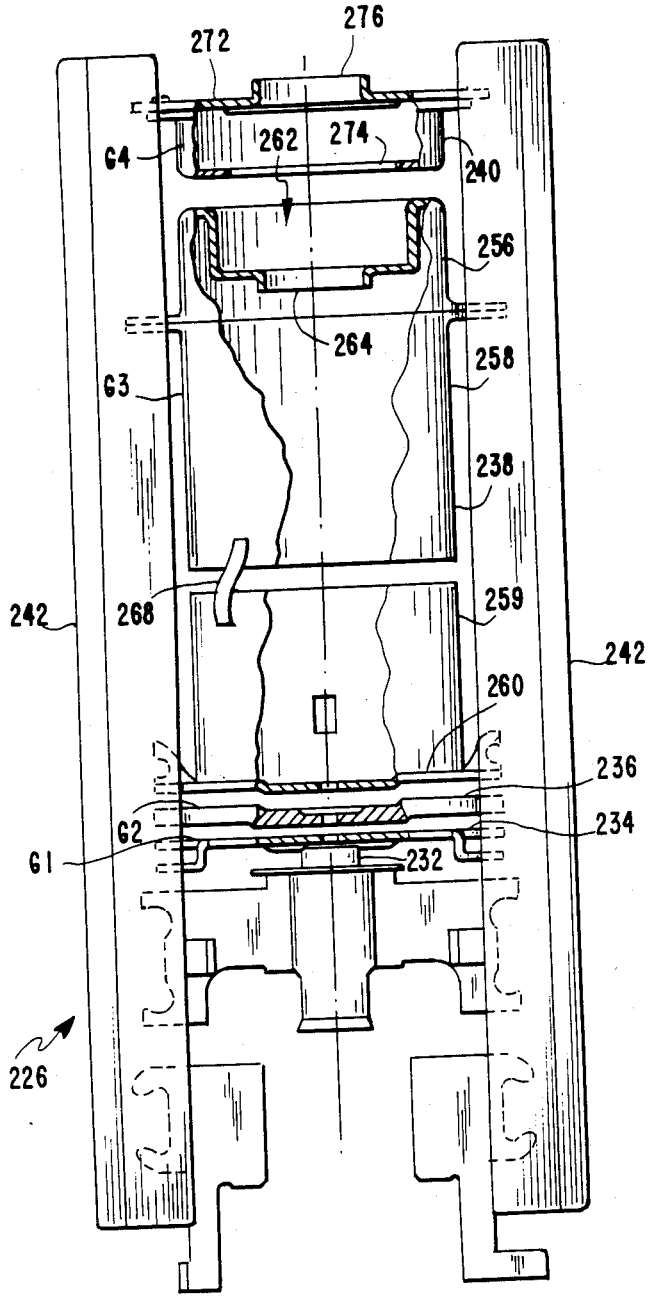
FIG. 4 is a side view, partially in section, of another improved electron gun.

Another improved electron gun embodiment is shown in FIG. 4. In this embodiment, a G3 electrode is divided into two parts to eliminate a thermally conductive heat path in the G3 electrode from the beam-forming region of the gun to the main focus lens region. Components, in an improved electron gun 226 of FIG. 4 that are similar to the components previously discussed with respect to the electron gun 26, are prefaced by the numeral 2.

The electron gun 226 of FIG. 4 is similar to the electron gun 26 except that a G3 electrode 238 of the gun 226 is formed by four elements: 256, 258, 259 and 260. The element 256 is identical to the element 56 of the gun 26, and the element 258 is similar to but shorter in length than the element 58. The element 259 is similar to the lower portion of the element 58. This element 259 is directly attached to the plate element 260 which is similar to the element 60 of the gun 26. The elements 258 and 259 are separated from each other and are electrically connected by a metal ribbon 268.

What is claimed is:

1. In a color picture tube including a neck having an electron gun therein, a funnel and a faceplate having a phosphor screen thereon, said electron gun including a plurality of cathodes and electrodes for generating three electron beams and directing the beams along paths toward said screen, said cathodes and electrodes being interconnected to a plurality of electrically insulative support rods, said cathodes and at least two of said electrodes comprising a beam-forming region of said electron gun, two of said electrodes, a first focus electrode and a second focus electrode, forming a main focus lens in the paths of the three electron beams, said main focus lens being spaced toward said screen from said beam-forming region, and means in the main focus lens for converging at least two electron beams, the improvement comprising said first focus electrode including two separated portions that are electrically connected, a first portion including three apertures therein facing the beam-forming region and a second portion positioned to form said main focus lens with said second focus electrode, said second portion including three apertures therein facing said second focus electrode, said first portion being connected to said support rods immediately adjacent to said beam-forming region and said second portion only being interconnected to said support rods at a location near said main focus lens, whereby during tube operation the temperature of said first portion is relatively close to the temperature of an adjacent electrode of the beam-forming region and the temperature of said second portion is relatively close to the temperature of said second electrode.

2. The tube as defined in claim 1 wherein said first portion of said first focus electrode has a thermal mass similar to that of an adjacent electrode of the beam-forming region.

* * * * *